United States Patent [19]

Eckerle

[11] Patent Number: 4,893,997

[45] Date of Patent: Jan. 16, 1990

[54] INTERNAL-GEAR MACHINE

[75] Inventor: Otto Eckerle, Malsch, Fed. Rep. of Germany

[73] Assignee: Otto Eckerle GmbH & Co. KG, Malsch, Fed. Rep. of Germany

[21] Appl. No.: 214,194

[22] Filed: Jul. 1, 1988

[30] Foreign Application Priority Data

Jul. 16, 1987 [DE] Fed. Rep. of Germany ..... 3723557

[51] Int. Cl.[4] ..... F04C 1/06; F04C 15/00

[52] U.S. Cl. ..... 418/126; 418/170

[58] Field of Search ..... 418/126, 169, 170

[56] References Cited

U.S. PATENT DOCUMENTS

| | | | |
|---|---|---|---|
| 3,289,599 | 12/1966 | Eckerle et al. | 418/126 |
| 3,890,066 | 6/1975 | Eckerle | 418/126 X |
| 4,132,514 | 1/1979 | Eckerle | 418/126 X |
| 4,132,515 | 1/1979 | Kruger | 418/170 X |
| 4,392,799 | 7/1983 | Shikano et al. | 418/126 X |
| 4,472,123 | 9/1984 | Eckerle et al. | 418/126 |
| 4,778,363 | 10/1988 | Buchmuller | 418/126 |
| 4,780,071 | 10/1988 | Buchmuller | 418/126 |

*Primary Examiner*—Michael Koczo

*Attorney, Agent, or Firm*—Hoffmann & Baron

[57] ABSTRACT

An internal-gear machine such as a pump comprises a casing with an internally toothed annular gear mounted therein. An externally toothed pinion meshes with the internal teeth of the annular gear over a portion thereof, and an arcuate filling member is disposed between the annular gear and the pinion. The filling member has a first end of substantial thickness in the radial direction of the assembly and tapers almost to a point at the second end, and is mounted in the casing by means of at least one mounting pin. The pin is arranged at a spacing from the first end of the filling member, which is towards the intake chamber defined between the annular gear and the pinion, and the pin has a mounting portion engaging into a groove in a side surface of the filling member. The filling member is thus rotatable about the axis of the pin and displaceable by virtue of displacement of the mounting portion in the groove in the filling member.

13 Claims, 3 Drawing Sheets

INTERNAL-GEAR MACHINE

BACKGROUND OF THE INVENTION

The invention relates generally to an internal-gear machine such as an internal-gear pump.

Generally, in internal-gear machines of that kind, such as a pump, an externally toothed pinion or pump impeller is mounted eccentrically with respect to the body of the pump for actuating an internally toothed annular gear which rotates in the casing of the pump. Flow through the pump is practically continuous and without reversals and high rotary speeds may be used. In order to reduce leakage, a filling member may be disposed in the clearance between the internally and externally toothed gears, the filling member extending generally in the circumferential direction of the annular gear and being of an arcuate or sickle-shaped configuration. The filler member may be mounted movably in the casing in such a way that in operation it can follow the movements of the internally toothed annular gear and the externally toothed pinion which mesh with each other, in order thereby to compensate for radial leakage gaps which occur by virtue of the movement of those components (see German laid-open application (DE-OS) No. 15 53 027 and Swiss patent specification No. 601 670). Specific control of the hydraulic forces acting on the filling member, such control being provided by means of pilot control grooves or slots provided on the filling member and/or surfaces of the arrangement which bear thereagainst, with such grooves or slots being subjected to a preliminary filling action to provide the above-mentioned control (see the above-quoted German laid-open application) is designed to ensure that the filling member is at least partially held by the action of the hydraulic forces in the optimum position required for producing the sealing action in each situation of use, that is to say, the filling member is suitable pressed against the tips of the teeth of the internally toothed annular gear and the externally toothed pinion. By virtue of the above-indicated control configuration, the direction and the magnitude of the forces involved is determined by the level of the operating pressure obtaining in the pressure chamber defined between the pinion and the annular gear, and the configuration of the separating surface, which is governed by the control requirement, between the intake chamber and the pressure chamber defined within the casing between the annular gear and the pinion. However, strictly speaking, those forces are unambiguously defined only when the machine is operating in a steady state. In contrast, if there is no operating pressure obtaining in the pressure chamber of the machine or if the machine is operating in a condition in which the pressure in the intake chamber thereof even exceeds the pressure in the pressure chamber, which may be the case when using filling pumps which are connected at an upstream location, then the filling member is subjected to the effect of forces which urge it towards the location at which the teeth of the pinion and the annular gear come into mesh with each other. In that situation, in conjunction with the frictional forces between the filling member and the tips of the teeth of the pinion and the annular gear, which forces act in any case on the filling member in the above-indicated direction, there is the risk that the filling member may be entrained by the movement of the pinion and the annular gear and may then become wedged and jammed between them at the location at which they come into meshing engagement with each other. That results in immediate seizure of the machine, with adverse consequences on the items of equipment connected thereto.

In order to reduce the risk of such a jamming effect, the filling member may be mounted in the casing, in the clearance between the externally toothed pinion and the internally toothed annular gear, in such a way that it is rotatable and slidable in the casing. That form of mounting can be achieved by means of a mounting pin which is carried rotatably in a bore in the casing, and a mounting portion which is displaceable in a groove. In that way, the filling member is held securely in both circumferential directions in the casing, without thereby adversely affecting the freedom of movement for the purposes of compensating for the radial clearance. However that kind of construction suffers from the disadvantage that the mounting pin which passes through the filling member is of restricted diameter, having regard to the dimensions of the filling member, and therefore is not capable of withstanding high operating pressures. Therefore, in order to be able to use higher operating pressures with that arrangement, the design configuration has been amended to provide for mounting pins for the filling member, which extend entirely outside the filling member, which have a support surface for the filling member and which for that reason can be of a stronger construction. However, in order to avoid the above-mentioned jamming effect in that construction, the arrangement also included a spring pin for the purposes of retaining the filling member in position, as disclosed for example in German laid-open application (DE-OS) No 23 12 085. However, in the above-mentioned operating condition in which the pressure in the intake chamber is the predominant pressure in the arrangement, the spring pin is not always capable of reliably preventing the filling member from being drawn into the location of meshing engagement between the teeth of the pinion and the annular gear when the machine is running. That also applies to an increased extent in situations in which the material being conveyed for example by the pump is of very low viscosity and possibly may also not have any kind of lubricating action.

It will be appreciated that, when dealing with materials of that kind, which are of low viscosity, in order to provide an adequate sealing effect it is necessary for the filling member to be longer than when the machine is designed for dealing with material to be conveyed which is of higher viscosity. However the increased length of filling member results in the filling member being in simultaneous engagement with the tips of a larger number of teeth in the assembly, which in turn results in a higher level of frictional force seeking to pull the filling member into the location of meshing engagement between the teeth of the annular gear and the pinion.

SUMMARY OF THE INVENTION

An object of the present invention is to provide an internal-gear machine which is capable of dealing in particular with a material to be conveyed of low viscosity, without involving excessive leakage and frictional forces.

Another object of the present invention is to provide an internal-gear machine which is not subject to the above-discussed restrictions in regard to the magnitude of the operating pressure in the machine.

Yet another object of the present invention is to provide an internal-gear machine which can operate with high operating pressures without incurring the risk of overloading of the means for mounting the filling member between the annular gear and the pinion, and without a severe risk of the filling member being pulled into the location of meshing engagement between the annular gear and the pinion.

Still another object of the present invention is to provide an internal-gear pump which is versatile in use and more efficient in operation.

In accordance with the principles of the present invention, these and other objects are achieved by an internal-gear machine such as an internal-gear pump comprising a casing having as cavity therein, in which an internally toothed annular gear is rotatably disposed. Disposed within the annular gear is an externally toothed pinion meshing with the teeth of a portion of the annular gear, and disposed between the gear and the pinion is a filling member in the form of a half-sickle configuration and extending in the circumferential direction. The filling member is mounted in the housing rotatably and displaceably relative thereto by a mounting arrangement comprising a mounting trunnion or pin which is arranged at a spacing from the end of the filling member that is towards the intake chamber defined between the annular gear and the pinion. The mounting pin is carried rotatably in a bore in the casing. The mounting arrangement for the filling member further comprises a mounting portion which projects from the mounting pin and which engages in to a groove in a side surface of the filling member, being slidable therein to permit movement of the filling member in a generally radial direction relative to the pinion and the annular gear.

The invention thus provides that displacing the location of the mounting for the filling member from the end thereof which is towards the intake chamber of the machine, towards the tip thereof, where the filling member is closest to the location of meshing engagement between the teeth of the annular gear and the pinion, gives a greater degree of freedom in regard to the positioning of the mounting portion so that on the one hand the mounting portion may have a mounting surface which is of the largest possible size, thus providing a correspondingly low level of pressure in relation to surface area, while on the other hand it is also possible to ensure that the resultant of the hydraulic forces acting on the filling member from the pressure chamber of the machine also passes through the mounting surface without the pressure chamber having to be unnecessarily increased in size. It will be appreciated that, with an increasing level of operating pressure, it must be an attractive proposition to keep the pressure chamber as small as possible in order thereby to keep the loading on the machine within reasonable limits. Particularly in the case of filling members which, for the reasons indicated above, must be greater length, it is possible to arrange the construction in such a way that the resultant of the hydraulic forces is directed to the mounting surface for the filling member, only if an increase in the size of the pressure chamber is also accepted because to achieve that aim the surface of separation between the intake chamber and the pressure chamber at the filling member, by means of the above-mentioned control configuration, must be arranged further away from the tip or downstream end of the filling member. The configuration in accordance with the invention in which the filling member is in practice extended beyond its mounting arrangement at which it is supported relative to the casing, in the direction of the intake chamber, makes it possible for the resultant of the hydraulic forces to be directed towards the mounting surface afforded by the mounting portion without having to tolerate and increase in the size of the pressure chamber. In addition, the mounting portion may be provided on the mounting pin means in any desired fashion at the end face thereof, including in eccentric relationship with respect thereto, depending on the position of the groove in the respective side surface of the filling member, thus providing for the maximum support area.

It will be noted that the filling member is of a shape corresponding to half a sickle-like configuration, that is to say, it is of an arcuate configuration with one end being of considerably greater thickness than the second end, with the second end thus tapering down almost to a point. In that respect, in connection with internal-gear machines comprising a filling member in the form of a complete sickle-like configuration with both the ends thereof tapering down virtually to a point, the filling member may be mounted on a filling member support pin, at the longitudinal centre of the filling member, However, by virtue of the symmetrical configuration of that filling member, with both end portions tapering down substantially to a point at respective sides of the longitudinal central position thereof, the central mounting of that filling member, in the region in which it is of its greatest thickness, is the only reasonably viable mounting location. If half that sickle configuration were to be removed, to provide a filling member approximately corresponding in shape to the filling member in accordance with the present invention, the resulting half-sickle configuration would be mounted at the end of the filling member which is towards the intake chamber of the machine.

In an advantageous feature of the invention, the at least one mounting pin is arranged in the half of the filling member which is towards the end thereof that is towards the intake chamber of the machine, and in the limit case is disposed at the longitudinal centre of the filling member. In addition, advantageous kinematic conditions in regard to compensation for the radial gap in the machine are achieved by the axis of rotation of the mounting pin means passing through the filling member at a position which is closer to the circumferential surface thereof that is towards the annular gear. In that construction the mounting portion is of an asymmetric configuration with respect to the axis of rotation of the mounting pin means as it is displaced with respect to the filling member, in accordance with the eccentric positioning of the axis of the mounting pin means relative to the filling member.

As already indicated above, the fact that the filling member is mounted at a position which is displaced towards the trailing end or tip of the filling member provides a greater degree of freedom in regard to the orientation of the mounting surface on which the filling member is slidable. In connection with the direction and the magnitude of the resultant of the hydraulic forces acting on the filling member being influenced by control slots or pilot-control filling grooves, the mounting surface and the groove accommodating the mounting portion in the side surface of the filling member will always be disposed in such a way as to provide for optimum distribution of the forces urging the filling member on the one hand towards the pinion and on the other hand towards the annular gear. However that always permits a compromise which provides for a relatively large mounting surface and, as a result thereof, a low level of pressure in relation to unit of area thereof.

The mounting portion which is desirably in one piece with the mounting pin means, in the simplest embodiment of the present invention, has two flat surfaces which are in mutually parallel relationship. Of those surfaces, the mounting surface which is towards the tip or trailing end of the filling member provides support for the filling member with respect to the hydraulic and other forces which act on the arrangement in operation thereof, while the surface which is towards the intake chamber of the machine is a retaining surface which carries the forces acting on the filling member from the intake chamber of the machine, and also the frictional forces applied to the filling member by the movement of the externally toothed pinion and the internally toothed annular gear. As those forces which are in opposition to each other do not coincide with each other in terms of direction, particularly when the filling member is of considerable length, thus providing that the frictional force component of the forces involved is the greater, it is possible to envisage arranging for the mounting surfaces on the mounting portion to extend at a suitable angle to each other, with that angle normally opening towards the annular gear. In that case therefore the mounting portion is of a wedge-shaped cross-sectional configuration, with the above-mentioned retaining surface, at the side thereof which is towards the intake chamber, being so disposed that the pressure forces acting on the arrangement from the intake chamber, and the frictional forces, are directed normal or almost normal to that surface. The play between the filling member and the retaining surface may always be kept at a low value, when the mounting surface and the retaining surface are in plane-parallel relationship. In the case of the above-discussed embodiment of the mounting portion which is of wedge-like cross-sectional configuration, that is possible to a particular degree as, because of the wedge shape, the play decreases when the filling member moves towards the annular gear.

The above-defined configuration in accordance with the teaching of this invention may in principle also be used in relation to filling members which comprise a plurality of portions (see German laid-open application (DE-OS) No. 26 06 082). In that case the groove which is provided at one side of the filling member, or, when the arrangement has first and second mounting pins, the grooves which are provided at respective sides of the filling member, advantageously passes through all the parts or segments constituting the filling member. In a particularly preferred embodiment of the filling member in which it is made up of a comparatively thin-gauge sealing segment and a segment carrier portion, with the sealing segment bearing against the teeth of the annular gear, the above-mentioned retaining surface of the mounting portion is not a flat surface but has a bend or kink therein at a location corresponding to the junction between the sealing segment and the segment carrier portion. That configuration takes account of the fact that the forces acting on the segment carrier portion and the sealing segment, from the intake chamber of the machine, and the frictional forces generated in operation of the arrangement, are in different directions. The above-defined configuration of the retaining surface of the mounting portion is required in order to orient the retaining surface in such a way that the hydraulic forces and the frictional forces are carried thereby in perpendicular relationship thereto, in the above-discussed fashion.

Further objects, features and advantages of the machine in accordance with the present invention will be apparent from the following description of embodiment thereof.

DESCRIPTION OF PREFERRED EMBODIMENTS

Figure 1:
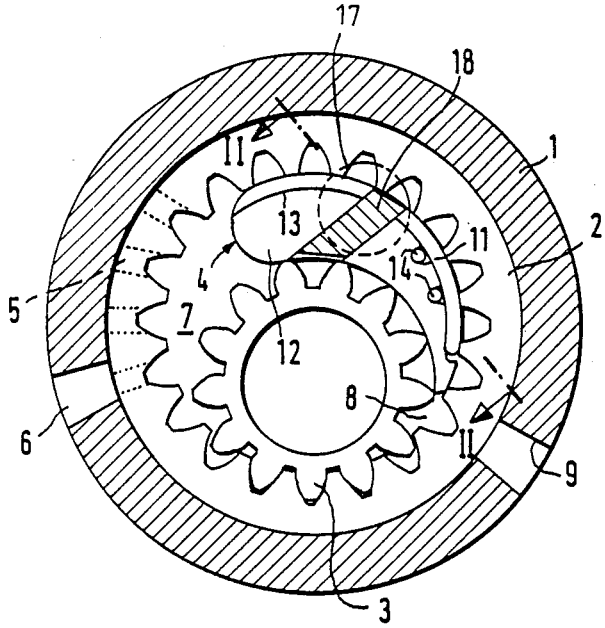
FIG. 1 is a diagrammatic view in cross-section through a first embodiment of an internal-gear pump according to the invention, with a filling member of divided construction.

Referring firstly to FIG. 1, shown therein is an embodiment of an internal-gear machine in the form of a pump comprising a casing which is generally indicated at 1, an internally toothed annular gear 2 which is mounted rotatably in the casing 1 by means of the circumferential surface of the annular gear 2, an externally toothed pinion 3 which is rotatably mounted in the casing and which is carried on a rotary shaft (not shown), and a filling member which is generally identified by reference numeral 4.

Over its entire periphery the annular gear 2 carries orifices 5 of which only some are shown and which permit the material to be conveyed, which passes into the machine by way of an intake opening 6, to pass into an intake or suction chamber as indicated at 7 and out of the pressure or discharge chamber 8 again, the medium being conveyed then being discharged through a pressure port 9. The above-described configuration of the pump is of generally conventional nature and therefore does not need to be discussed in greater detail.

The filling member 4 illustrated is of an arcuate configuration in the form of a comma-like or half-sickle-like shape. This, one end thereof, which is shown at top left in FIG. 1, is of substantial thickness when viewing the filling member 4 in cross-section, while the other end of the filling member 4, which is at bottom right in FIG. 1 and constitutes the trailing end of the filling member 4, is of much narrower thickness and decreases almost to a point. The filling member 4 is of a progressively tapering configuration over its arcuate length, as is clearly visible in FIG. 1.

The filling member 4 illustrated in FIG. 1 is of comparatively great length so that the outer circumferential surface thereof is simultaneously in contact with a multiplicity of teeth on the annular gear 2, more specifically being in contact with nine teeth in FIG. 1, in order to provide a sealing effection of optimum effectiveness, for the purposes of conveying particularly low-viscosity fluids.

In the illustrated embodiment of FIG. 1, the filling member 4 is made up of a shell-like sealing element 11 and a segment carrier portion 12. The segment 11 and the carrier portion 12 bear against each other along a junction surface as indicated at 13, which extends in the circumferential direction of the annular gear 2. The segment 11 and the carrier portion 12 are sealed relative to each other by means of sealing rolling members 14.

Figure 2:
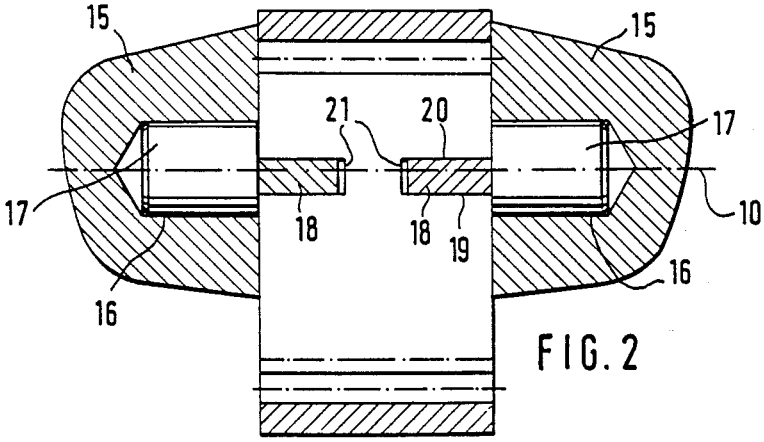
FIG. 2 is a view in section taken along line II—II in FIG. 1, illustrating part of the arrangement shown therein.

Referring now additionally to FIG. 2, illustrated therein are two lateral casing plates 15 which have respective blind bores 16 for rotatably mounting a respective mounting pin or trunnion 17. The mounting pins 17 are operatively associated with the two side surfaces of the filling member 4 and have mounting portions 18 which are provided integrally thereon and which project towards the filling member 4 from the end of the respective mounting pin 17. The mounting portions 18 each comprise two plane-parallel surfaces. Of those surfaces, the surface 19 which is towards the tip or trailing end of the filling member 4 constitutes the mounting surface for carrying the forces acting on the arrangement from the pressure chamber 8, while the oppositely disposed surface 20 constitutes a retaining surface for supporting the filling member 4 relative to the forces which act from the intake chamber 7.

As can be seen from FIG. 1, the mounting pins 17 are so arranged relative to the filling member 4 that the axis of rotation 20 of the mounting pins 17 is displaced towards the tip of the filling member 4, and is thus disposed at a spacing from the left-hand end of the filling member 4. The axis of rotation 20 of the mounting pins 17 is disposed at a position such that it divides the length of the filling member 4 approximately in a ratio of 2:3. In addition the rotary axis 20 is disposed adjacent to the surface 13 between the sealing segment 11 and the segment carrier portion 12, so that the axis 20 is thus closer to the radially outward surface of the filling member 4 than the radially inward surface thereof, thus being displaced towards the tip of the teeth of the annular gear 2, relative to the central line extending lengthwise of the filling member 4.

Provided in the axially facing side surfaces of the sealing segment 11 and the segment carrier portion 12 are respective grooves 21 which correspond to the respective mounting portions 18 and which are intended to accommodate same. The sides of the grooves 21 thus bear against the mounting surface 19 and the retaining surface 20 respectively and transmit thereto the forces acting on the filling member 4.

The configuration of the grooves 21 and the mounting portions 18 which engage thereinto can be seen from FIGS. 1 and 2, from which it will also be seen that, as a result of the axis 20 of rotary movement of the mounting pins 17 being arranged eccentrically with respect to the filling member 4, the mounting portions 18 are arranged eccentrically relative to the end face of the respective mounting pin 17, in a direction towards the externally toothed pinion 3.

It will also be seen from FIG. 1 that the mounting portions 18 substantially fill the grooves 21 of the filling member 4, more specifically at their boundary surfaces which are towards the inner and outer peripheries of the filling member 4, the mounting portions are at least substantially adapted to the peripheral configuration of the filling member 4 at those locations, in order thereby to make the surfaces 19 and 20 of the largest possible area. As can also be seen from FIG. 1, the sides of the respective grooves 21 extend at an angle of approximately 30° relative to that plane in which the axis of the pinion 3 and the axis 20 of rotary movement of the mounting pins 17 are disposed. That positioning substantially ensures that on the one hand the forces acting on the filling member 4 and originating from the pressure chamber 8 are distributed in such a way that the filling member 4 is in optimum sealing contact with both the annular gear 2 and the externally toothed pinion 3, while on the other hand the pressure in relation to unit of surface area, which occurs at the mounting surface 19, is minimised. The direction of the resultant of the hydraulic forces which act on the arrangement from the pressure chamber 8 is established in the usual fashion by control slots (not shown) in the axial plates 15 and/or the side surfaces of the filling member 4 (reference may be made in that respect to German laid-open application (DE-OS) No. 15 53 027).

Figure 2A:
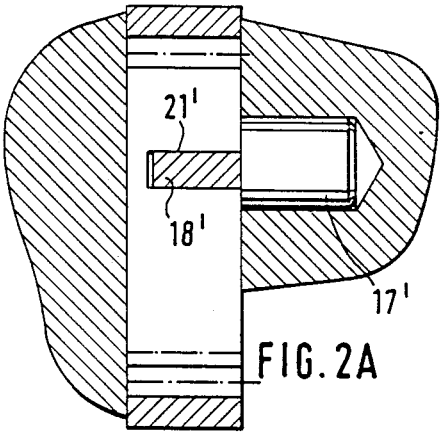
FIG. 2A is a sectional view similar to that shown in FIG. 2, of a modified construction with only one mounting pin.

Reference will now be made to FIG. 2A showing part of an embodiment which differs from the embodiment described above with reference to FIGS. 1 and 2 only in that, instead of the first and second mounting pins 17 which are respectively associated with the two side surfaces of the filling member 4, the construction shown in FIG. 2A has only one mounting pin 17' which is arranged at one side of the filling member 4 and which engages by means of a mounting portion 18' disposed on the end face thereof into a groove 21' provided in one side surface of the filling member 4.

Figure 3:
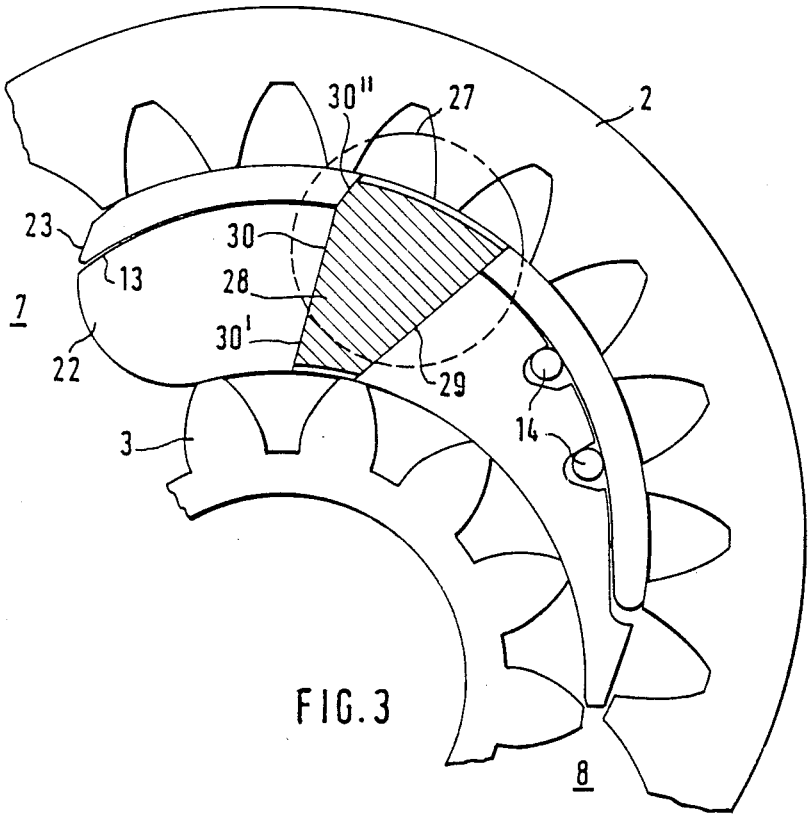
FIG. 3 is a view in cross-section similar to that shown in FIG. 1 but illustrating only part of the arrangement, through a second embodiment of an internal-gear pump according to the invention.

The embodiment of the invention shown in FIG. 3 differs from that described above with reference to FIGS. 1 and 2 solely by virtue of the particular configuration of the mounting portions 28 on the respective mounting pins 27, which respectively correspond to the mounting portions 18 and the mounting pins 17 shown in FIGS. 1 and 2. For that reason, the other components of the internal-gear pump are denoted in FIG. 3 by the same reference numerals as those used in FIGS. 1 and 2.

Thus, on the mounting portion 28 illustrated in FIG. 3, the mounting surface 29, as in the case of the embodiment shown in FIGS. 1 and 2, extends at an angle of about 30° relative to the plane containing the axis of rotation of the mounting pin 27 and the externally toothed pinion 3, and is of a flat configuration throughout. On the other hand, the retaining surface 30 forms an acute angle relative to the mounting surface 29, as can be clearly seen from FIG. 3, and is subdivided into a first surface portion 30' which is operatively associated with the segment carrier portion 22, and a second surface portion 30'' which is operatively associated with the shell-like sealing segment 23 carried by the carrier portion 22 radially outwardly thereof. The surface portions 30' and 30'' meet in the region of the junction surface 13 between the carrier portion 22 and the sealing segment 23, in angular relationship to each other, so that the retaining surface 30 has a bend or kink therein. That construction takes account of the fact that the forces acting on the arrangement from the intake chamber 7 act on the carrier portion 22 and the sealing segment 23 in different directions so that it is necessary for the surface portions 30' and 30'' operatively associated with the carrier portion 22 and the sealing segment 23 to be inclined at different angles, in order for the above-mentioned forces to act on the respective surface portions 30' and 30'' in perpendicular relationship.

Figure 4:
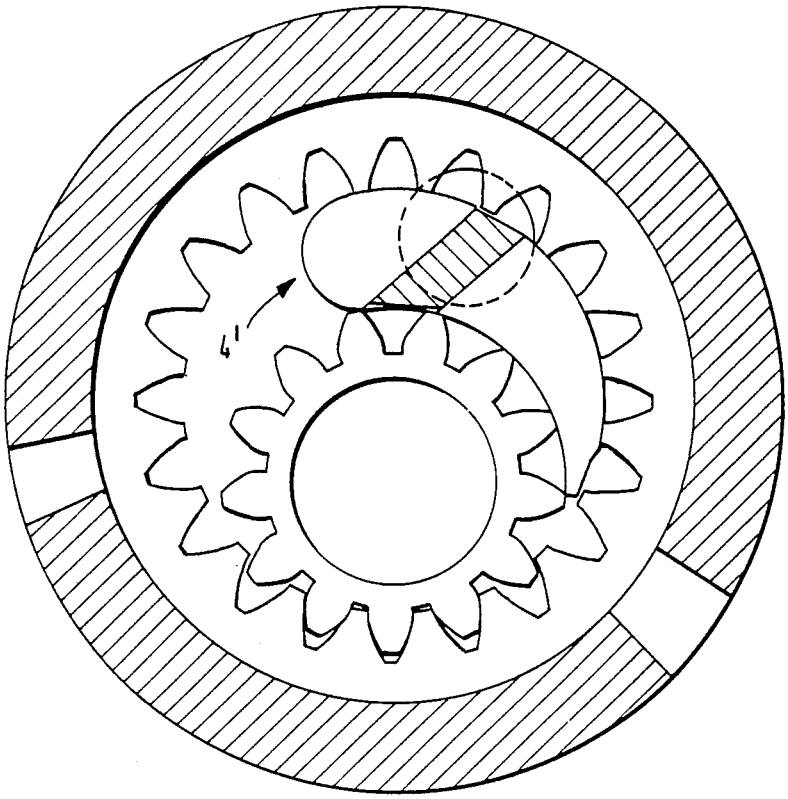
FIG. 4 is a view in cross-section similar to that shown in FIG. 1, through a third embodiment of an internal-gear pump according to the invention, with a one-piece filling member.

Reference will now be made to FIG. 4 showing a construction which substantially corresponds to that shown in FIGS. 1 and 2, the only difference being that the FIG. 4 construction does not have a divided or split filling member 4 but a one-piece filling member 4'. Grooves for receiving the mounting portions of the arrangement for mounting the filling member 4' in the clearance between the internally toothed annular gear and the externally toothed pinion are provided in the axially facing side surfaces of the filling member 4'.

It will be seen from the foregoing description that the manner of mounting the filling member 4 or 4' in accordance with the principles of the invention makes it possible to operate the machine at higher operating pressures, without overloading the mounting pin configuration and the mounting portion thereof, while reliably avoiding the risk of the filling member being pulled into the area of initial meshing engagement between the teeth of the annular gear and the pinion.

It will be appreciated that the above-described embodiments have been set forth solely by way of example and illustration of the present invention and various modifications and alterations may be made therein without thereby departing form the spirit and scope of the invention.

What is claimed is:

1. An internal-gear machine comprising:

a casing;

an internally toothed annular gear in the casing;

an externally toothed pinion disposed within the annular gear and meshing with a portion of the annular gear, a clearance being provided between said pinion and the remaining portion of the annular gear;

a filling member of a configuration generally corresponding to half a sickle shape so as to taper from a first end towards a second end thereof and having circumferential faces and side surfaces, the filling member being disposed in said clearance and extending substantially in the circumferential direction of the annular gear with said circumferential faces thereof in contact with the tips of the teeth on the pinion and on the annular gear and partitioning said clearance into an intake chamber on the side of said first end and a pressure chamber on the side of said second end, said filling member having a groove formed in a side surface thereof;

means supporting said filling member on said casing rotatably and displaceably therein, said supporting means comprising mounting pin means mounted rotatably in a bore in said casing, and a mounting portion carried on said mounting pin means in projecting relationship therefrom, said mounting portion being received in said groove in the side surface of said filling member, said mounting pin means being disposed at a spacing away from said first end of said filling member, towards said second end thereof.

2. A machine as set forth in claim 1 wherein the mounting pin means includes a respective mounting pin with a mounting portion thereon arranged at each side of the filling member, and each of said side surfaces of the filling member has a respective said groove.

3. A machine as set forth in claim 1 wherein the filling member has a longitudinal centre line extending through said first and second ends of the filling member, and wherein the mounting pin means is arranged substantially on the longitudinal centre line of the filling member.

4. A machine as set forth in claim 1 wherein the mounting pin means is arranged in relation to the longitudinal extent of the filling member at a location closer to said first end than said second end, dividing the arcuate length of the filling member in a ratio of two to three.

5. A machine as set forth in claim 1 wherein said groove accommodating said mounting pin means extends in the side surface of the filling member at an angle to the plane connecting the axis of said pinion and the axis of rotation of the mounting pin means.

6. A machine as set forth in claim 5 wherein said angle is substantially 30°.

7. A machine as set forth in claim 1 wherein said filling member is divided into a plurality of portions along at least one separating line extending substantially in the circumferential direction.

8. A machine as set forth in claim 7 wherein the groove in the side surface of the filling member passes through the side surfaces of all said filling member portions.

9. An internal-gear machine comprising:

a casing;

an internally toothed annular gear in the casing;

an externally toothed pinion disposed within the annular gear and meshing with a portion or the annular gear, a clearance being provided between said pinion and the remaining portion of the annular gear;

a filling member of a configuration generally corresponding to half a sickle shape so as to taper from a first end towards a second end thereof and having circumferential faces and side surfaces, the filling member being disposed in said clearance and extending substantially in the circumferential direction of the annular gear with said circumferential faces thereof in contact with the tips of the teeth on the pinion and on the annular gear and partitioning said clearance into an intake chamber on the side of said first end and a pressure chamber on the side of said second end, said filling member having a groove in a side surface thereof;

means supporting said filling member on said casing rotatably and displaceably therein, said supporting means comprising mounting pin means mounted rotatably in a bore in said casing, and a mounting portion carried on said mounting pin means in projecting relationship therefrom, said mounting portion being received in said groove in the side surface of said filling member, said mounting pin means being disposed at a spacing away from said first end of said filling member towards said second end thereof, and wherein the axis of rotation of the mounting pin means passes through the filling member more closely adjacent to the circumferential surface thereof which is at the side towards said annular gear.

10. An internal-gear machine comprising:

a casing;

an internally toothed annular gear in the casing;

an externally toothed pinion disposed within the annular gear and meshing with a portion of the annular gear, a clearance being provided between said pinion and the remaining portion of the annular gear;

a filling member of a configuration generally corresponding to half a sickle shape so as to taper from a first end towards a second end thereof and having circumferential faces and side surfaces, the filling member being disposed in said clearance and extending substantially in the circumferential direction of the annular gear with said circumferential faces thereof in contact with the tips of the teeth on the pinion and on the annular gear and partitioning said clearance into an intake chamber on the side of said first end and a pressure chamber on the side of said second end, said filling member having a groove in a side surface thereof;

means supporting said filling member on said casing rotatably and displaceably therein, said supporting means comprising mounting pin means rotatably in a bore in said casing, and a mounting portion carried on said mounting pin means in projecting relationship therefrom, said mounting portion being received in said groove in the side surface of said filling member, said mounting pin means being disposed at a spacing away from said first end of said filling member, towards said second end thereof, and wherein said clearance defines the surface of the mounting portion which is towards the pressure chamber and the surface of the mounting portion which is towards the intake chamber, and the sides of the groove which are operatively associated with said surfaces, extend relative to each other at an acute angle which opens towards said annular gear.

11. An internal-gear machine comprising:

a casing;

an internally toothed annular gear in the casing;

an externally toothed pinion disposed within the annular gear and meshing with a portion of the annular gear, a clearance being provided between said pinion and the remaining portion of the annular gear;

a filling member of a configuration generally corresponding to half a sickle shape so as to taper from a first end towards a second end thereof and having circumferential faces and side surfaces, the filling member being disposed in said clearance and extending substantially in the circumferential direction of the annular gear with said circumferential faces thereof in contact with the tips of the teeth on the pinion and on the annular gear and partitioning said clearance into an intake chamber on the side of said first end and a pressure chamber on the side of said second end, said filling member having a groove in a side surface thereof;

means supporting said filling member on said casing rotatably and displaceably therein, said supporting means comprising mounting pin means mounted rotatably in a bore in said casing, and a mounting portion carried on said mounting pin means in projecting relationship therefrom, said mounting portion being received in said groove in the side surface of said filling member, said mounting pin means being disposed at a spacing away from said first end of said filling member towards said second end thereof, and wherein said filling member is divided into a plurality of portions along at least one separating line extending substantially in the circumferential direction, and wherein said filling member is divided into a carrier portion and a radially outward sealing segment carried on said carried portion and wherein the surface of said mounting portion which is at the side towards the intake chamber has a bend therein at a location corresponding to the junction between the sealing segment and the carrier portion.

12. An internal-gear machine comprising:

a casing;

an internally toothed annular gear mounted rotatably in the casing;

an externally toothed pinion rotatably disposed within the annular gear and meshing with a portion thereof, a clearance being provided between said pinion and the remaining portion of the annular gear, thereby defining an intake chamber and a pressure chamber between said pinion and said annular gear;

a generally arcuate filling member tapering from a first end towards a second end thereof and having circumferential faces and first and second side surfaces, said filling member being disposed in said clearance and extending substantially in the circumferential direction of said annular gear with said circumferential faces thereof in contact with the tips of the teeth of the pinion and on the annular gear and partitioning said clearance into said intake chamber on said side of first end and said pressure chamber on the side of said second end;

a bore in said casing at a side of said casing adjacent a respective said side surface of said filling member; and mounting means mounting said filling member in said casing rotatably and slidably relative thereto, said mounting means including a first mounting pin means accommodated in said bore, a groove extending in said first side surface of said filling member, and a mounting portion carried by said mounting pin means and slidably engaging into said groove in said first side surface of said filling member, said groove being so positioned in said filling member that said mounting pin means support said filling member at a location thereon spaced away from said first end of the filling member towards said second end thereof.

13. A machine as set forth in claim 12 wherein said casing has bores at respective sides of said filling member adjacent said first and second side surfaces thereof, wherein said mounting means includes first and second pins accommodated in respective ones of said bores, and wherein each of said first and second side surfaces of said filling member has a respective groove for slidably receiving a respective said mounting portion on each said pin.

* * * * *